US009439008B2

(12) United States Patent
Shennib

(10) Patent No.: US 9,439,008 B2
(45) Date of Patent: Sep. 6, 2016

(54) ONLINE HEARING AID FITTING SYSTEM AND METHODS FOR NON-EXPERT USER

(71) Applicant: iHear Medical, Inc., San Leandro, CA (US)

(72) Inventor: Adnan Shennib, Oakland, CA (US)

(73) Assignee: iHear Medical, Inc., San Leandro, CA (US)

( * ) Notice: Subject to any disclaimer, the term of this patent is extended or adjusted under 35 U.S.C. 154(b) by 285 days.

(21) Appl. No.: 14/011,607

(22) Filed: Aug. 27, 2013

(65) Prior Publication Data

US 2015/0023512 A1 Jan. 22, 2015

Related U.S. Application Data

(60) Provisional application No. 61/847,032, filed on Jul. 16, 2013.

(51) Int. Cl.
*H04R 25/00* (2006.01)

(52) U.S. Cl.
CPC ..... *H04R 25/70* (2013.01)

(58) Field of Classification Search
CPC ..... H04R 25/70
USPC ..... 381/60, 314
See application file for complete search history.

(56) References Cited

U.S. PATENT DOCUMENTS

| | | | |
|---|---|---|---|
| 4,759,070 | A | 7/1988 | Voroba |
| 5,197,332 | A | 3/1993 | Shennib |
| 5,327,500 | A | 7/1994 | Campbell |
| 5,553,152 | A | 9/1996 | Newton |

(Continued)

FOREIGN PATENT DOCUMENTS

| | | | |
|---|---|---|---|
| JP | 2008109594 | A | 5/2008 |
| KR | 1020050114861 | A | 12/2005 |

(Continued)

OTHER PUBLICATIONS

"Basic Guide to in Ear Canalphones", Internet Archive, Head-Fi.org, Jul. 1, 2012. Retrieved from http://web.archive.org/web/20120701013243/http:www.head-fi.org/a/basic-guide-to-in-ear-canalphones> on Apr. 14, 2015.

(Continued)

*Primary Examiner* — Paul S Kim
*Assistant Examiner* — Katherine Faley
(74) *Attorney, Agent, or Firm* — Dorsey & Whitney LLP

(57) ABSTRACT

Methods and systems of interactive online fitting of a hearing aid by a non-expert consumer without requiring a clinical setup are disclosed. In one embodiment, the system includes an audio generator for delivering test audio signals at predetermined levels to a non-acoustic input of a programmable hearing aid in-situ, and a programming interface for delivering programming signals to the hearing aid. The consumer is instructed to listen to the output of the hearing device in-situ and to interactively adjust fitting parameters according to a subjective assessment of audible output representative of the test audio signal. In one embodiment, the online-based fitting system comprises a personal computer, a handheld device connected to the personal computer, and a fitting application hosted by a server. In one embodiment, remote customer support personnel may communicate with a hearing aid worn by the consumer and interactively control fitting parameters.

46 Claims, 8 Drawing Sheets

(56) References Cited

U.S. PATENT DOCUMENTS 5,645,074 A 7/1997 Shennib et al.
5,659,621 A 8/1997 Newton
5,701,348 A 12/1997 Shennib et al.
5,785,661 A 7/1998 Shennib et al.
5,928,160 A 7/1999 Clark
6,137,889 A 10/2000 Shennib et al.
6,212,283 B1 4/2001 Fletcher et al.
6,319,207 B1 11/2001 Naidoo
6,359,993 B2 3/2002 Brimhall
6,367,578 B1 4/2002 Shoemaker
6,379,314 B1 4/2002 Horn
6,382,346 B2 5/2002 Brimhall et al.
6,428,485 B1 8/2002 Rho
6,447,461 B1 9/2002 Eldon
6,473,513 B1 10/2002 Shennib et al.
6,522,988 B1 2/2003 Hou
6,546,108 B1 4/2003 Shennib et al.
6,674,862 B1 1/2004 Magilen
6,724,902 B1 4/2004 Shennib et al.
6,840,908 B2 1/2005 Edwards et al.
6,937,735 B2 8/2005 DeRoo et al.
6,940,988 B1 9/2005 Shennib et al.
6,978,155 B2 12/2005 Berg
7,010,137 B1 3/2006 Leedom et al.
7,016,511 B1 3/2006 Shennib
7,037,274 B2 5/2006 Thoraton et al.
7,113,611 B2 9/2006 Leedom et al.
7,215,789 B2 5/2007 Shennib et al.
7,260,232 B2 8/2007 Shennib
7,298,857 B2 11/2007 Shennib et al.
7,310,426 B2 12/2007 Shennib et al.
7,321,663 B2 1/2008 Olsen
7,403,629 B1 7/2008 Aceti et al.
7,424,123 B2 9/2008 Shennib et al.
7,424,124 B2 9/2008 Shennib et al.
7,580,537 B2 8/2009 Urso et al.
7,664,282 B2 2/2010 Urso et al.
7,854,704 B2 12/2010 Givens et al.
7,945,065 B2 5/2011 Menzl et al.
8,073,170 B2 12/2011 Kondo et al.
8,077,890 B2 12/2011 Schumaier
8,155,361 B2 4/2012 Schindler
8,184,842 B2 5/2012 Howard et al.
8,243,972 B2 8/2012 Latzel
8,284,968 B2 10/2012 Schumaier
8,287,462 B2 10/2012 Givens et al.
8,379,871 B2 2/2013 Michael et al.
8,396,237 B2 3/2013 Schumaier
8,447,042 B2 5/2013 Gurin
8,467,556 B2 6/2013 Shennib et al.
8,503,703 B2 8/2013 Eaton et al.
8,571,247 B1 10/2013 Oezer
8,718,306 B2 5/2014 Gommel et al.
8,798,301 B2 8/2014 Shennib
9,031,247 B2 * 5/2015 Shennib ..... H04R 25/70 381/60
9,078,075 B2 7/2015 Shennib et al.
9,107,016 B2 * 8/2015 Shennib ..... H04R 25/70
9,326,706 B2 5/2016 Shennib
2001/0008560 A1 7/2001 Stonikas et al.
2001/0009019 A1 * 7/2001 Armitage ..... H04R 25/70 710/64
2001/0051775 A1 12/2001 Rho
2002/0027996 A1 3/2002 Leedom et al.
2002/0085728 A1 7/2002 Shennib et al.
2003/0007647 A1 1/2003 Nielsen et al.
2003/0078515 A1 4/2003 Menzel et al.
2004/0028250 A1 * 2/2004 Shim ..... H04R 25/70 381/312
2004/0073136 A1 * 4/2004 Thornton ..... A61B 5/12 600/559
2004/0165742 A1 8/2004 Shennib et al.
2005/0094822 A1 5/2005 Swartz
2005/0226447 A1 10/2005 Miller, III
2005/0245991 A1 11/2005 Faltys et al.
2005/0249370 A1 11/2005 Shennib et al.
2005/0259840 A1 11/2005 Gable et al.
2005/0283263 A1 12/2005 Eaton et al.
2006/0094981 A1 * 5/2006 Camp ..... H04R 25/70 600/559
2006/0210104 A1 9/2006 Shennib et al.
2006/0291683 A1 12/2006 Urso et al.
2007/0071265 A1 3/2007 Leedom et al.
2007/0076909 A1 4/2007 Roeck et al.
2007/0189545 A1 * 8/2007 Geiger ..... A61B 5/121 381/60
2007/0237346 A1 10/2007 Fichtl et al.
2008/0240452 A1 10/2008 Burrows et al.
2008/0273726 A1 11/2008 Yoo et al.
2010/0040250 A1 2/2010 Gerbert
2010/0119094 A1 5/2010 Sjursen et al.
2010/0145411 A1 6/2010 Spitzer
2010/0191143 A1 7/2010 Ganter
2010/0226520 A1 9/2010 Feeley et al.
2010/0239112 A1 9/2010 Howard et al.
2010/0268115 A1 10/2010 Wasden et al.
2010/0284556 A1 11/2010 Young
2011/0058697 A1 3/2011 Shennib et al.
2011/0176686 A1 * 7/2011 Zaccaria ..... H04R 25/70 381/60
2011/0188689 A1 8/2011 Beck et al.
2011/0190658 A1 8/2011 Sohn et al.
2011/0200216 A1 8/2011 Lee et al.
2011/0206225 A1 8/2011 Møller et al.
2012/0051569 A1 3/2012 Blamey et al.
2012/0095528 A1 * 4/2012 Miller, III ..... A61N 1/36032 607/57
2012/0130271 A1 5/2012 Margolis et al.
2012/0177212 A1 7/2012 Hou et al.
2012/0177235 A1 7/2012 Solum
2012/0183164 A1 7/2012 Foo et al.
2012/0183165 A1 7/2012 Foo et al.
2012/0189140 A1 7/2012 Hughes
2012/0213393 A1 8/2012 Foo et al.
2012/0215532 A1 8/2012 Foo et al.
2012/0285470 A9 11/2012 Sather et al.
2012/0302859 A1 11/2012 Keefe
2013/0010406 A1 1/2013 Stanley
2013/0177188 A1 7/2013 Apfel et al.
2013/0182877 A1 7/2013 Angst et al.
2013/0223666 A1 8/2013 Michel et al.
2013/0243209 A1 9/2013 Zurbruegg et al.
2013/0243227 A1 * 9/2013 Kinsbergen ..... H04M 1/2475 381/314
2013/0243229 A1 9/2013 Shennib et al.
2013/0294631 A1 11/2013 Shennib et al.
2014/0003639 A1 1/2014 Shennib et al.
2014/0150234 A1 6/2014 Shennib et al.
2014/0153761 A1 6/2014 Shennib et al.
2014/0153762 A1 6/2014 Shennib et al.
2014/0254843 A1 9/2014 Shennib
2014/0254844 A1 9/2014 Shennib
2015/0023534 A1 1/2015 Shennib
2015/0023535 A1 1/2015 Shennib
2015/0025413 A1 1/2015 Shennib
2015/0215714 A1 7/2015 Shennib et al.
2015/0256942 A1 * 9/2015 Kinsbergen ..... H04R 25/30 381/313
2016/0066822 A1 3/2016 Shennib et al.
2016/0080872 A1 3/2016 Shennib et al.
2016/0198271 A1 7/2016 Shennib

FOREIGN PATENT DOCUMENTS

KR 100955033 B1 4/2010
WO 99/07182 2/1999
WO 2010/091480 8/2010
WO 2011128462 A2 10/2011
WO 2015009559 A1 1/2015
WO 2015009561 A1 1/2015
WO 2015009564 A1 1/2015

(56) References Cited

FOREIGN PATENT DOCUMENTS

| | | | |
|---|---|---|---|
| WO | 2015009569 | A1 | 1/2015 |
| WO | 2016044178 | A1 | 3/2016 |

OTHER PUBLICATIONS

"dB HL—Sensitivity to Sound—Clinical Audiograms", Internet Archive, AuditoryNeuroscience.com, Apr. 20, 2013. Retrieved from <https://web.archive.org/web/20130420060438/http://www.auditoryneuroschience.com/ac oustics/clinical_audiograms>on Apr. 14, 2015.

"The Audiogram", Internet Archive, ASHA.org, Jun. 21, 2012. Retrieved from <https:/web.archive.org/web/20120621202942/http://www.asha.org/public/hearing/Audiogram> on Apr. 14, 2015.

Amlani, et al., "Methods and Applications of the Audibility Index in Hearing Aid Selection and Fitting", Trends in Amplication 6.3 (2002) 81. Retrieved from <https://www.ncbi.nim.nih.gov/pmc/articles/PMC4168961/> on Apr. 14, 2015.

International Search Report and Written Opinion dated Nov. 3, 2010 for PCT Appl. No. PCT/US2010/048299.

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.

"Methods for Calculation of the Speech Intelligibility Index", American National Standards Institute, Jun. 6, 1997.

"Specification for Audiometers", American National Standards Institute, Nov. 2, 2010.

"User Manual—2011", AMP Personal Audio Amplifiers.

Abrams, "A Patient-adjusted Fine-tuning Approach for Optimizing the Hearing Aid Response", The Hearing Review, pp. 1-8, Mar. 24, 2011.

Asha, "Type, Degree, and Configuration of Hearing Loss", American Speech-Language-Hearing Association; Audiology Information Series, May 2011, pp. 1-2.

Convery, et al., "A Self-Fitting Hearing Aid: Need and Concept", http://tia.sagepubl.com, Dec. 4, 2011, pp. 1-10.

Franks, "Hearing Measurements", National Institute for Occupational Safety and Health, Jun. 2006, pp. 183-232.

Kiessling, "Hearing aid fitting procedures—state-of-the-art and current issues", Scandinavian Audiology, 2001, 57-59, vol. 30, Suppl 52.

Nhanes, "Audiometry Procedures Manual", National Health and Nutrition Examination Survey, Jan. 2003, pp. 1-105.

Traynor, "Prescriptive Procedures", www.rehab.research.va.gov/mono/ear/traynor.htm, Jan. 1999, pp. 1-16.

World Health Organization, "Deafness and Hearing Loss ", www.who.int/mediacentre/factsheets/fs300/en/index.html, Feb. 2013, pp. 1-5.

International Search Report and Written Opinion for PCT/US2014/046350 mailed Nov. 6, 2014.

International Search Report and Written Opinion for PCT/US2014/046316 mailed on Nov. 3, 2014.

International Search Report and Written Opinion for PCT/US2014/046323 mailed on Oct. 10, 2014.

International Search Report and Written Opinion for PCT/US2014/046335.

Internet Archive, World Health Organization website "Grades of Hearing Impairment". Retrieved from <https://web.archive.org/web/20121024120107/http://www.who.int/pbd/deafnes s/hearing_impairment_grades/en> on Aug. 27, 2015.

Kryter , "Methods for the calculation and use of the articulation index", The Journal of the Acoustical Society of America 34.11 (1962): 1689-1697. Retrieved from http://dx.doi.org/10.1121/1.1909094 on Aug. 27, 2015.

Sindhusake, et al., "Validation of self-reported hearing loss. The Blue Mountains hearing study", International Journal of Epidemiology 30.6 (2001 ): 1371-1378. Retrieved from <http://ije.oxfordjournals.org/content/30/6/1371.full> on Aug. 27, 2015.

* cited by examiner

ONLINE HEARING AID FITTING SYSTEM AND METHODS FOR NON-EXPERT USER

CROSS-REFERENCE TO RELATED APPLICATIONS

This application claims the benefit under 35 U.S.C. 119 of the earlier filing date of U.S. Provisional Application 61/847,032, entitled "ONLINE HEARING AID FITTING SYSTEM AND METHODS FOR A NON-EXPERT USER," filed Jul. 16, 2013. The aforementioned provisional application is hereby incorporated by reference in its entirety, for any purpose.

TECHNICAL FIELD

Examples described herein relate to methods and systems of online hearing aid fitting and more particularly rapid fitting and/or self-fitting of hearing aids by non-experts. This application is related to U.S. Pat. No. 8,467,556, titled CANAL HEARING DEVICE WITH DISPOSABLE BATTERY MODULE, and U.S. Publication No. 2013/0243229, titled BATTERY MODULE FOR PERPENDICULAR DOCKING INTO A CANAL HEARING DEVICE, and U.S. Publication No. 2014/0254844, titled RECHARGEABLE CANAL HEARING DEVICE AND SYSTEMS, which are incorporated herein by reference in their entirety for any purpose. This application is also related to concurrently filed U.S. patent applications, now issued U.S. Pat. No. 9,031,247, titled METHOD OF HEARING AID FITTING USING SOUND SEGMENTS REPRESENTING RELEVANT SOUNDSCAPE, now issued U.S. Pat. No. 9,326,706, titled HEARING PROFILE TEST SYSTEM AND METHOD, and now issued U.S. Pat. No. 9,107,016, titled INTERACTIVE HEARING AID FITTING SYSTEM AND METHODS, which are incorporated herein by reference in their entirety for any purpose.

BACKGROUND

Current hearing aid fitting systems and methods are generally complex, relying on specialized instruments for operation by hearing professionals in clinical settings. For example, a typical fitting system may include an audiometer for conducting a hearing evaluation, a software program for computing prescriptive formulae and corresponding fitting parameters, a hearing aid programming instrument to program the computed fitting parameters, a real ear measurement (REM) instrument for in-situ evaluation of the hearing aid, a hearing aid analyzer, calibrated acoustic transducers, sound proof room, etc. These systems and methods for using them are generally not suitable for self-administration by a hearing aid consumer in home settings.

Characterization and verification of a hearing aid are generally conducted by presenting acoustic stimuli (sound) to the microphone of the hearing device, referred to herein generically as a "microphonic" or "acoustic" input. The hearing aid may be worn in the ear (in-situ) during the fitting process, for what is referred to as "real ear" measurements (REM), using an REM instrument. The hearing aid may also need to be placed in a test chamber for characterization by a hearing aid analyzer. The acoustic stimulus used for hearing aid and fitting assessment is generally tonal sound, but may include synthesized speech spectrum noise, or other speech-like signals sometimes referred to as "digital speech." Real life sounds are generally not employed for determining a hearing aid prescription or for adjustment of the fitting parameters with the user's subjective assessment. Hearing aid consumers are generally asked to return to the dispensing office to make adjustments following real-life listening experiences with the hearing device. When simulated "real life" sounds are employed for hearing aid evaluation, calibration of the real life input sounds at the microphone of the hearing aid is generally required, involving probe tube measurements, or a sound level meter (SLM). Regardless of the particular method used, conventional fitting generally requires clinical settings to employ specialized instruments for administration by trained hearing professionals. Throughout this application, the term "consumer" generally refers to a person being fitted with a hearing device, thus may be interchangeable with any of the terms "user," "person," "client," "hearing impaired," etc. Furthermore, the term "hearing device" is used herein to refer to all types of hearing enhancement devices, including hearing aids prescribed for hearing impairment and personal sound amplification products (PSAP) generally not requiring a prescription or a medical waiver.

Programmable hearing aids rely on electronic adjustments of electroacoustic settings, referred to herein generally as "fitting parameters." Similar to hearing assessments and hearing aid characterization, the programming of a hearing aid generally requires specialized instruments and involvement of a hearing professional to deal with a range of complexities related to programming fitting parameters.

Resorting to consumer computing devices for hearing evaluation and fitting, such as personal computers, smartphones and tablet computers, to produce test stimuli is generally problematic for several reasons, including the variability of sound output characteristics with consumer audio components employed therewith. For example internal speakers or external headphones may not be easily calibrated and/or may not meet audio standards of audiometric and hearing aid evaluations, such as total harmonic distortion (THD), accuracy of amplitudes, noise levels, frequency response, and the like.

Furthermore, conventional fitting processes are generally too technical and cumbersome for administration by a non-expert person. For the aforementioned reasons, among others, the fitting process for a programmable hearing device is generally not available to consumers for self-administration at home. A hearing aid dispensing professional is typically required for conducting one or more steps of the fitting process, from hearing evaluation to hearing aid recommendation and selection to prescription and programming of the fitting parameters into the hearing device. This process often requires multiple visits to the dispensing office to incorporate the user's subjective assessment from listening experiences after the initial fitting. As a result, the cost of a professionally dispensed hearing aid can easily reach thousands of dollars, and almost double that for a pair of hearing aids. This expense represents a major barrier to many potential consumers. Even though cost of parts and labor to manufacture a hearing device is generally under $100, the average retail price for a programmable hearing aid is well over $1000, largely due to the cost of fitting by the dispensing professional. In addition to the cost, another obstacle for potential hearing aid customers is the inconvenience of the multiple visits to a dispensing office that are required for hearing aid testing, selection and fitting.

SUMMARY

The present disclosure relates to methods and systems for interactive fitting of a hearing device online by a non-expert user, without resorting to clinical setups and instrumentation. In one embodiment, the online fitting system may include an audio generator positioned on a client side, the audio generator configured to deliver calibrated test audio signals to an audio input of a programmable hearing device in-situ. The test audio signals correspond to sound segments at varied sound pressure levels and frequency characteristics. The online fitting system may also include a programming interface configured to interactively deliver programming signals to the hearing device in-situ. The online fitting method generally involves instructing the hearing device consumer to listen to the audible output of the hearing device in-situ and adjust fitting parameters of the hearing device interactively by delivering a sequence of test audio signals and programming signals according to the subjective assessment of the consumer from the audible output of the hearing device in-situ. In one embodiment, the user interface is browser-based and generally configured to allow the consumer to adjust fitting parameters using controls presented in subjective lay terms, such as volume, audibility, clarity, and the like, rather than generally objective methods, technical terms and complex graphical tools conventionally used by hearing professionals in clinical settings.

In some embodiments, the online fitting system includes a handheld fitting device, a personal computer, and web-based fitting software applications hosted on a remote web server. The handheld fitting device includes the audio generator configured to generate test audio signals and deliver the test audio signals to an input of the hearing device in-situ. The handheld fitting device is generally handheld-sized and may be worn on the body of the consumer or placed in the vicinity of the consumer's ear during the online fitting process. The handheld fitting device also comprises the programming circuitry configured to interactively deliver programming signals to the hearing device in-situ. The fitting device in one embodiment is provided with USB connectivity for interfacing with a broad range of personal computing devices, including smartphones and tablet computers.

In one embodiment, the online fitting system further comprises an earphone to conduct a hearing evaluation. In another embodiment, the hearing evaluation may be conducted by delivering acoustic test signals to an audio input of a hearing device in-situ. The online fitting system may also include a microphone configured to sense sound in the vicinity of the consumer.

The online fitting system and methods disclosed herein allow consumers to inexpensively and interactively test their own hearing ability, develop their own "prescription", and fine-tune the fitting parameters at home, without requiring conventional prescriptive methods, specialized fitting instruments and clinical software that are typically limited to clinical settings. In some embodiments, by delivering audio signals directly to an audio input of the hearing device, calibration of test sounds at the fitting site may be eliminated. The audio signal may be delivered directly, either electrically or wirelessly, to the hearing aid input. Similarly, the programming signal may be delivered electrically or wirelessly.

The disclosed systems and methods generally allow consumers to manipulate hearing aid parameters based on the subjective audibility of in-situ hearing aid output. In one embodiment, test audio segments are presented to the hearing aid input sequentially until all corresponding fitting parameters are manipulated and adjusted according to the consumer's preference. Subsequent adjustments after the initial fitting may be readily administered to refine the personally developed fitting prescription. Test audio segments used herein are preferably designed with minimal overlap in level and frequency characteristics to minimize overlap in fitting parameter control and to result in a convergent and expedited fitting process for self-administration by a non-expert hearing impaired consumer, or non-expert person assisting the hearing impaired customer.

In some embodiments, the online fitting system enables home hearing aid dispensing, including home hearing evaluation and home prescription and programming. The online process may be self-administered, resulting in reduced cost by eliminating expenses associated with professional services in clinical settings. In one embodiment, the home fitting system positioned is connected online to a remote customer support computer, allowing for remote hearing aid configuration, remote fitting parameter control, and audio streaming of instructions from customer support personnel. The audio streaming also allows for online delivery of test signals to the hearing aid of the consumer.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof, including the best mode presently contemplated of practicing the invention, when taken in conjunction with the accompanying drawings, in which.

DETAILED DESCRIPTION

Figure 1:
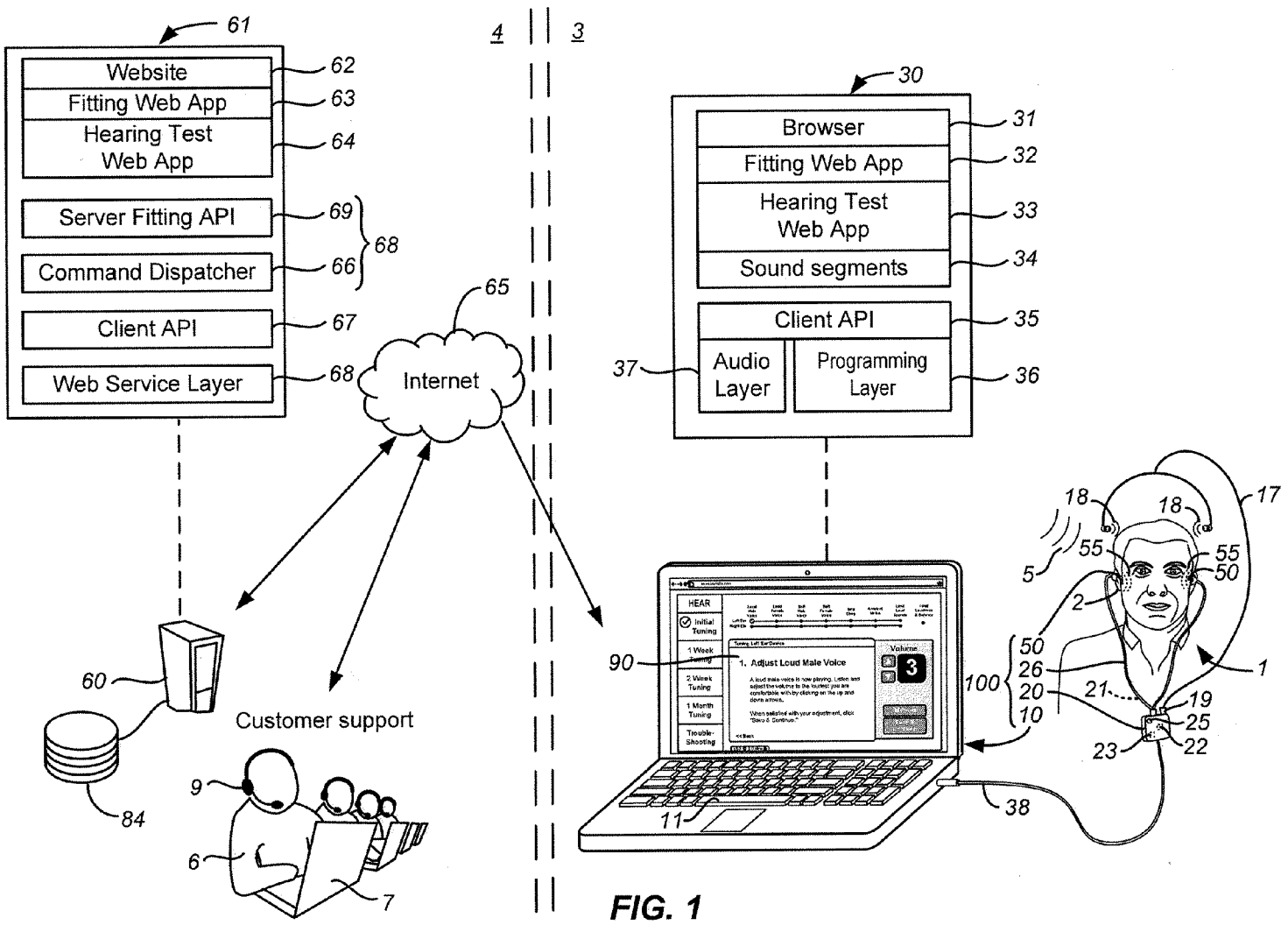
FIG. 1 is a representation of an online fitting system, including a handheld device incorporating an audio generator, a programming signal generator, a programmable hearing aid, a personal computer, an earphone, and a server hosting web-based fitting applications, according to one embodiment.

Certain details are set forth below to provide a sufficient understanding of embodiments of the invention. Some embodiments, however, may not include all details described. In some instances, well known structures may not be shown in order to avoid unnecessarily obscuring the described embodiments of the invention.

The present disclosure describes example online fitting systems and methods, shown in FIGS. 1-8, for automatically administering a hearing aid fitting by a non-expert, including self-fitting by a hearing device consumer 1, without resorting to clinical instrumentation, visits to hearing aid dispensing offices, or involvement of a hearing professional. In an example embodiment, shown in FIGS. 1 and 2, the online fitting system 100 includes components on a "client side" 3 and on a "remote side" 4, with respect to a consumer 1 positioned on the client side 3. On the client side 3, the fitting system 100 includes a personal computer 10, a portable fitting device 20 (also referred to as a "handheld device"), a programmable hearing device 50, and software components 30 that may be readily available online over the Internet 65 from a server 60 positioned on the remote side 4. The software components 30 on the client side may include a fitting web application 32, a hearing test web application 33, a web service layer 41 (FIG. 7), sound segments 34, an audio layer 37 and a programming layer 36. The web service layer 41 on the client side 3 comprises a Client API 35.

On the remote side 4, the server 60 generally hosts software components 61, which may include a fitting website 62 serving a fitting web application 63, a hearing test web application 64, and a web service layer 68 comprising a server fitting API 69 and Command Dispatcher 66. The fitting system 100 on the client side 3 includes an audio signal generator 22 and a programming signal generator 23, incorporated within the handheld fitting device 20, which may be worn on the body of the consumer 1 or placed in the vicinity of the consumer's ear 2. The audio signal generator 22 may be configured to deliver audio signals 21 directly to an input 51 of the hearing device 50.

During the hearing aid fitting process 71, audio signals 21 produced by the audio signal generator 22 correspond to sound segments 34, each of which generally has unique sound characteristics. The programming signal generator 23 may be configured to deliver programming signals 24 to the hearing device input 51 via a programming cable 26, or wirelessly to a wireless input, as will be described further below. The online fitting method generally involves instructing the consumer 1 to listen to hearing device output 55 (also referred to herein as "acoustic test signal") to interactively adjust fitting parameters 80 according to the subjective assessment and response to the hearing device output 55. As will be described in the example of FIG. 6, whereby the consumer 1 is offered familiar consumer-friendly perceptual controls, such as volume, audibility, clarity, and the like, instead of technical terms used in conventional fitting methods for operation by hearing professionals.

In one embodiment, the audio signal generator 22 may be a single chip audio system designed for converting digital audio streams from a personal computing device 10 to audio signals 21 for delivery to an audio input of the hearing device 50 in-situ. Sound segments 34 are typically represented by digital audio files stored in memory within the fitting system 100 and presented as test audio signals 21 at the client side 3. The programming signal generator 23 may include $I^2C$ (inter-integrated circuit) circuitry and firmware to implement $I^2C$ communication protocols as known in the art of electronics and programmable hearing aids. The fitting device 20 in the example embodiment of FIGS. 1 and 2 may include USB connectivity 38 for interfacing with a broad range of general purpose consumer computing devices 10, including a standard personal computer, a smartphone 13 (FIG. 4) or a tablet computer (not shown). The term "personal computer," as used herein, includes any type of computing device, including but not limited to those mentioned above.

Figure 2:
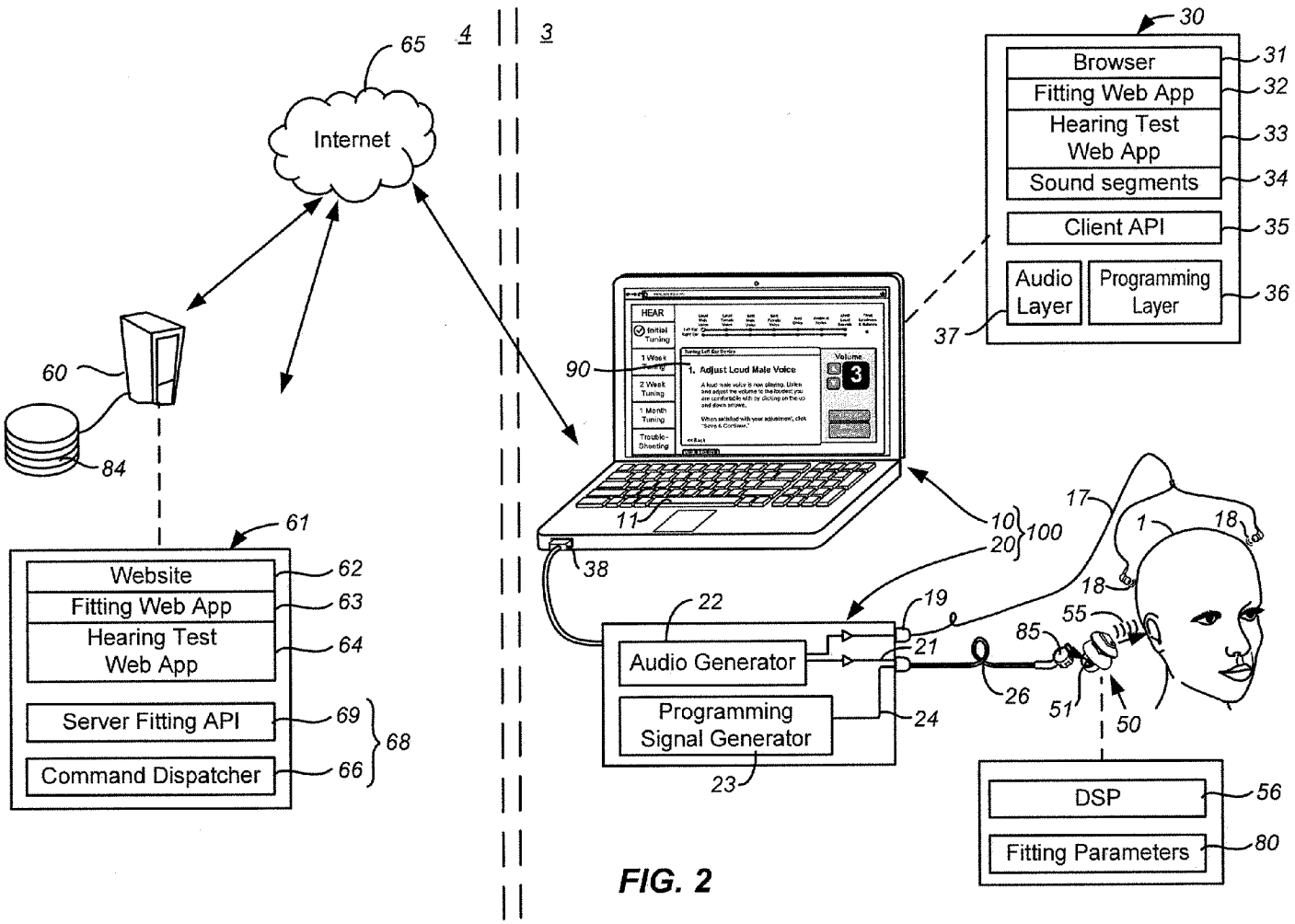
FIG. 2 is a detailed view of certain aspects of the online fitting system of FIG. 1, depicting a block diagram of the handheld device and a direct electrical audio input to the programmable hearing device, shown outside of the ear for clarity.

The delivery of programming signals 24 and test audio signals 21 directly to an input of a hearing device 50 may be electrical, as shown in FIGS. 1 and 2. For example, programming signals 24 and/or test audio signals 21 may be transmitted electrically by the programming cable 26 and a fitting connector 85 (FIG. 2). In one example, the fitting connector 85 may be inserted into a main module of a modular hearing device during the fitting process, as shown in FIG. 2. The fitting connecter 85 may be subsequently removed from the main module to insert a battery, or battery module, for example as per the disclosures of U.S. Pat. No. 8,467,556, incorporated herein by reference.

In the example embodiments shown in FIGS. 1 and 2, the fitting system 100 includes an earphone 17 coupled to the fitting device 20 via earphone connector 19. The earphone 17, comprising a speaker (receiver) receiver within, may be configured to deliver calibrated test sounds 18 to the ear 2 of the consumer 1 for conducting a hearing evaluation. The hearing evaluation may alternatively be conducted by delivering acoustic test signals 55 from the hearing device 50 in-situ. In some embodiments, acoustic test signals 55 are presented at supra-threshold sound levels, generally above 20 dB HL to enable hearing testing in quiet home environments, without requiring an ultra-quiet setting, for example a sound room in a clinical audiology setting. For example, a hearing test may present a sequence of supra-threshold test stimuli, generally above 20 dB HL with increments in the range of 10-20 decibels, up to test levels of approximately 70-80 dB HL. The test signals may be presented in frequency bands in the range of 400-8000 Hz. The consumer's minimum audibility response within the suprathreshold sound level range presented at each test frequency band may be registered using a personal computer, which may comprise a smartphone or a tablet computer. In an example embodiment, the acoustic stimuli presented are in the suprathreshold range of 30-80 dB HL, with a test increment of approximately 10 decibels, presented at frequency bands of 500, 1000, 2000, 4000 and 6000 Hz. A score may be computed based on minimal audibility level (MAL) within the suprathreshold range presented, and weighted by appropriate factors such as the speech intelligibility index (SII) as per American National Standards ANSI/ASA S3.5.

Figure 3:
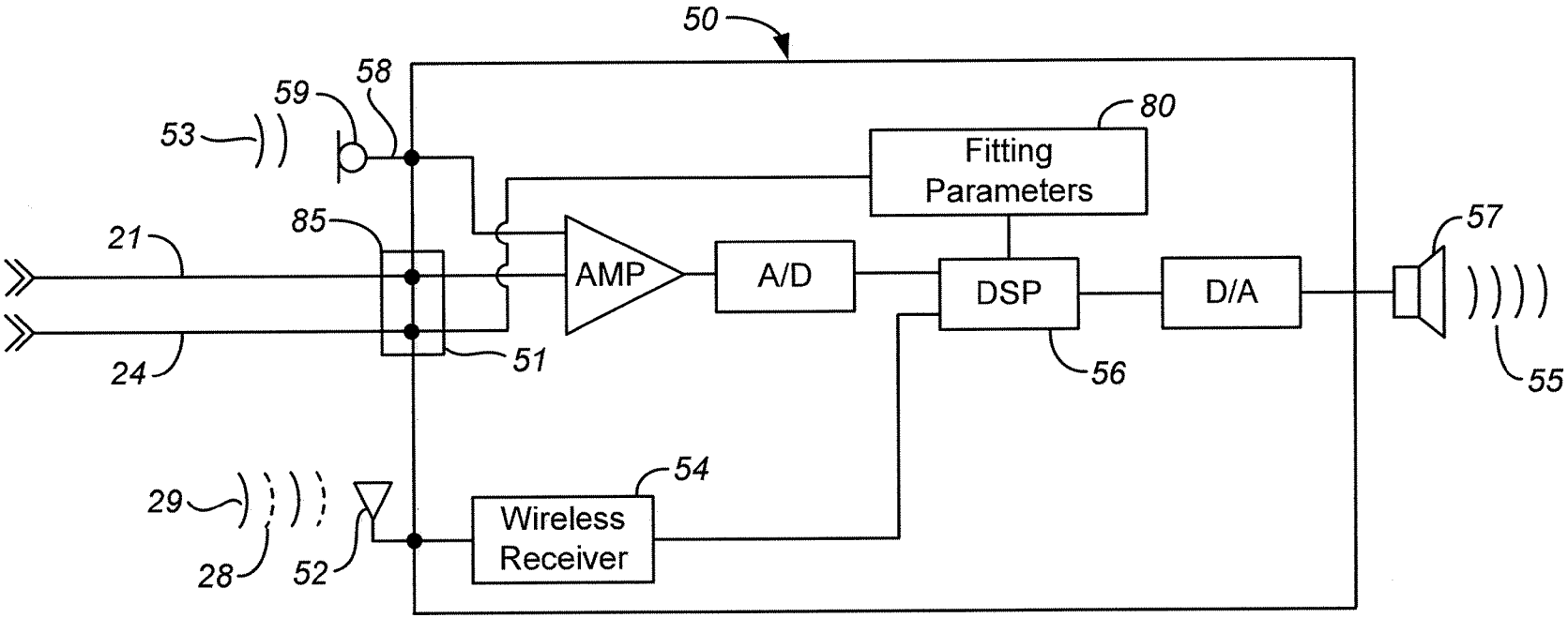
FIG. 3 is a block diagram depicting a programmable hearing aid, showing audio input options including microphone (acoustic) input, electrical audio input, and wireless audio input, for implementing calibrated audio signal delivery, according to one embodiment.

FIG. 3 is a block diagram of an example hearing aid to illustrate audio input alternatives, for example acoustic input, sometimes referred to herein as microphonic input. The acoustic signal generally refers to signals related to a hearing aid microphone 59, for example microphone signal 58 produced by the hearing aid microphone 59, or test sound 53 presented to the hearing aid microphone 59. A non-acoustic input generally refers to alternate audio inputs for the hearing aid 50, which may be a wired input 51 or a wireless input 52. The wired input 51 may be configured to directly receive audio signals 21 or programming signals 24 electrically. Alternatively, the wireless input 52, in conjunction with a wireless receiver 54, may be configured to receive wireless audio signals 28 and/or wireless programming signals 29 using a wireless signal protocol, for example Bluetooth. FIG. 3 also shows components incorporated within a typical modern hearing device, including a digital signal processor 56 (DSP), a memory for storing fitting parameters 80 and other data, and a speaker 57 (also known as a "receiver"), typically for delivering amplified sound to the hearing impaired consumer 1. Although FIG. 3 depicts an embodiment wherein acoustic, wired and wireless audio input options co-existing, some or all these input options may or may not co-exist in a typical hearing aid application, and the various options are shown herein as co-existing to demonstrate alternatives to acoustic input for delivering test audio signals for a hearing aid during fitting and hearing evaluations according to the present disclosures.

By delivering audio signals directly to a non-acoustic input of a hearing device 50, delivery and calibration of a test sound 53 from an external speaker (not shown) to the hearing aid microphone 59 may be eliminated. For example, if a 120 μV audio signal 21 is determined to correspond to 60 dB SPL for a sound segment, referenced to hearing aid microphone 59 input, simulation of other sound input levels may be readily computed by a software application and presented using proper scaling factors. For example, to present the sound segment equivalent to 80 dB SPL, the audio signal 21 may be delivered at 1.2 mV (+20 dB=10× electrically). Similar correlation and intrinsic calibration characteristic also apply to wireless audio signals 28. In other embodiments (not shown), delivery of test acoustic signals to the hearing aid may be implemented with a calibrated circumaural headphone with its speaker positioned in proximity to the microphone of the in-situ hearing device 50, for example a canal hearing aid as shown in FIGS. 1 & 2.

Figure 4:
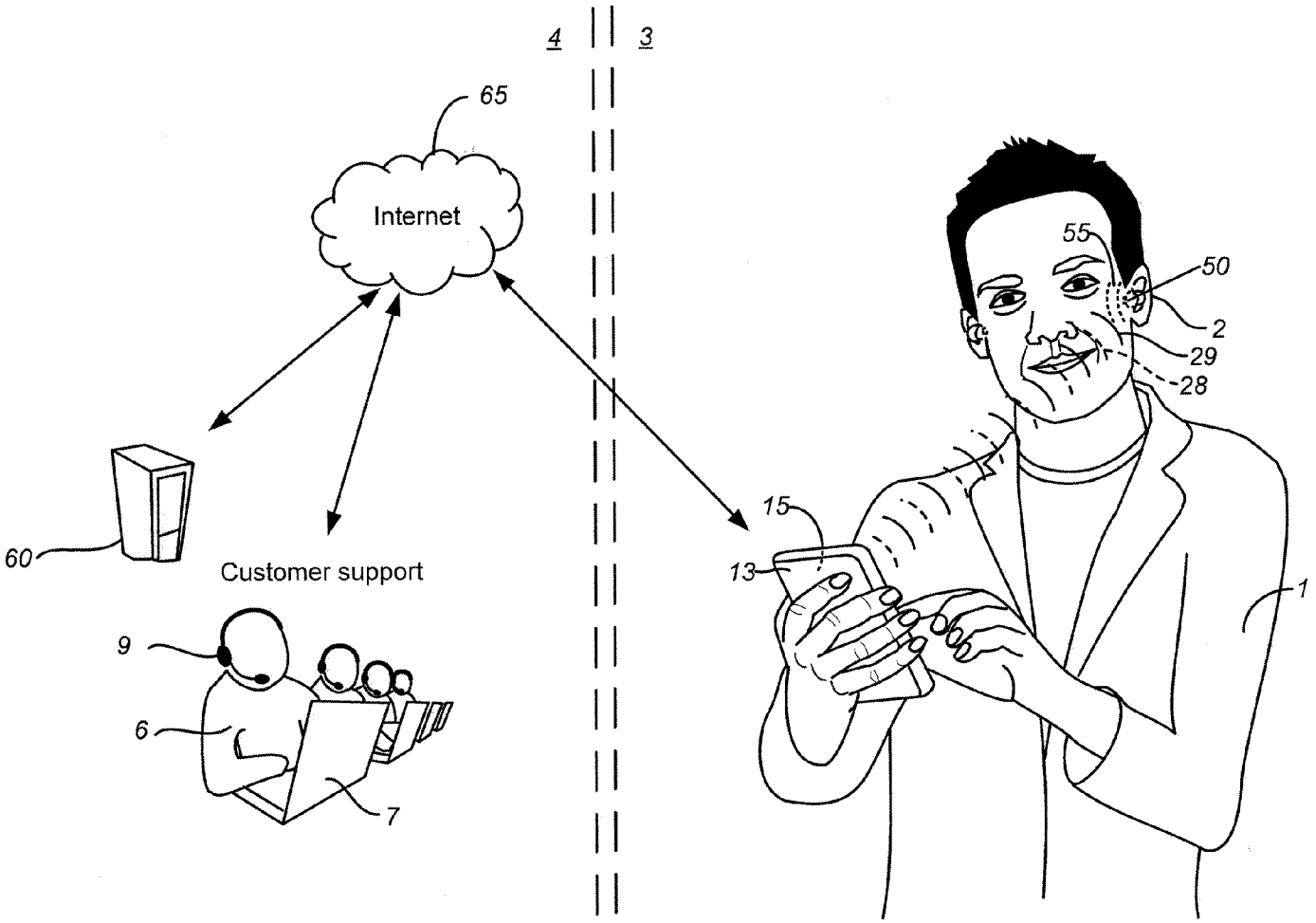
FIG. 4 is a representation of a wireless online fitting system configured to perform wireless audio streaming and wireless programming using a smartphone with wireless features, according to one embodiment.

FIG. 4 shows a wireless embodiment of the online fitting system whereby wireless audio signal 28 and wireless programming signal 29 are transmitted from a smartphone 15 with wireless features to implement the online fitting process, in conjunction with a wireless embodiment of the programmable hearing device 50 comprising a wireless input 52 as in FIG. 3. The consumer 1 may follow instructions presented thereto, for example on a touch screen 13 of the smartphone 15, and register a subjective assessment of audibility of test signals 55 from the hearing device 50 in the ear 2, using an input interface provided within smartphone 13, for example a key or the touch screen 15. The hearing device 50 being fitted may be of any type and configuration, including a canal hearing aid, in the ear (ITE) hearing aid, receiver in the canal (RIC) hearing aid, or behind the ear (BTE) hearing aid.

In some embodiments, a fitting system microphone 25 may be incorporated into the fitting system 100, such as on the handheld fitting device 20 (FIG. 1), within any of the cabling (not shown), or on the personal computer 10. The microphone 25 may be configured to sense or measure sound 5 in the vicinity of the consumer 1. For example, the microphone 25 may be configured to measure the level of ambient background noise during a hearing evaluation. The microphone 25 may also be configured to measure and indicate noise levels to the consumer 1 during the fitting process. The microphone may also be configured to relay audio signals including speech signals 16 (FIG. 8) from the consumer 1 to a remotely located customer support personnel 6. The microphone 25 may also be configured to detect oscillatory feedback (whistling) from an in-situ hearing aid 50. The detected oscillatory feedback may be mitigated by the online fitting system 100, automatically, or by the consumer 1 by adjusting a fitting parameter related to the occurrence of feedback.

Figure 5:
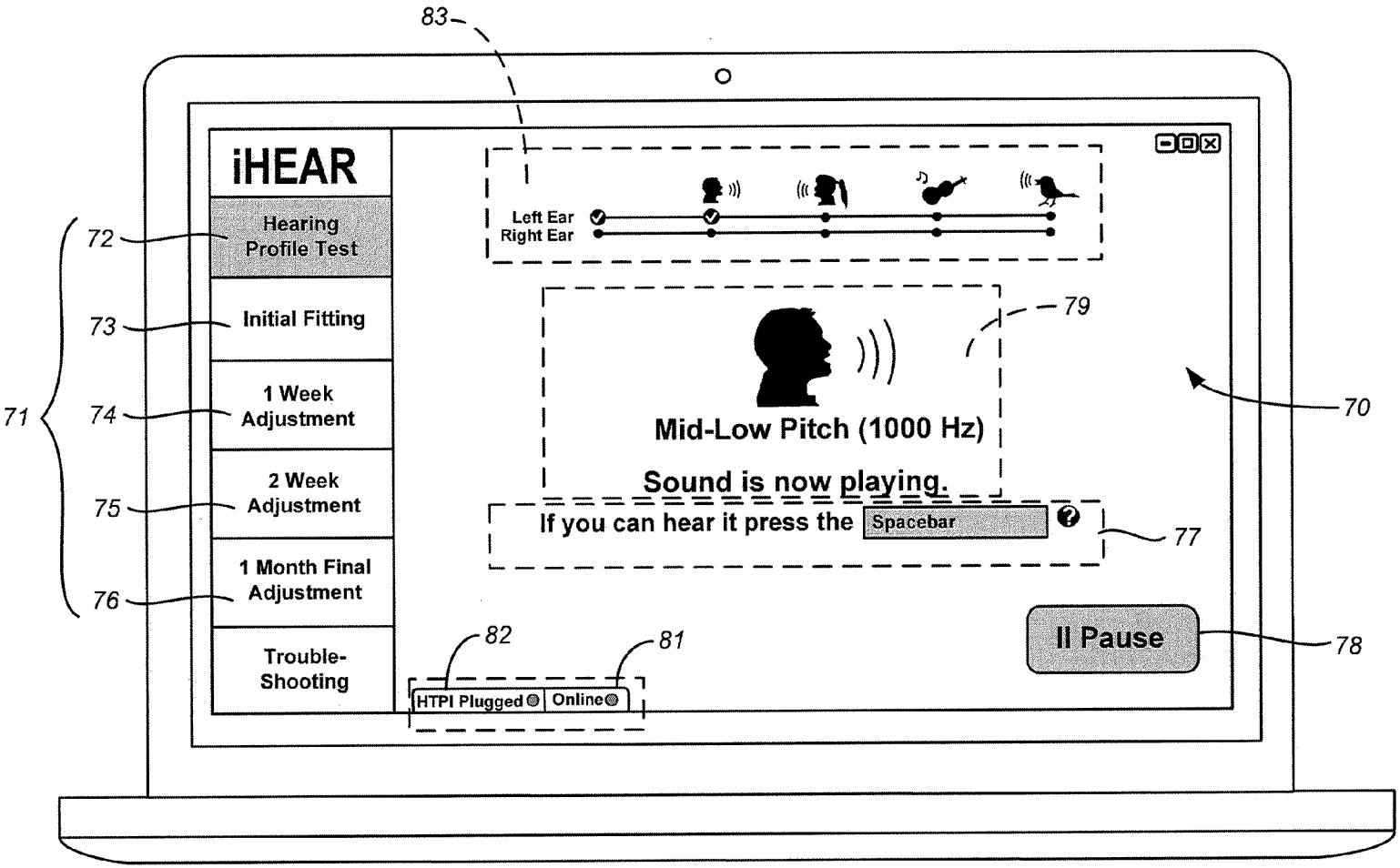
FIG. 5 is a representation of a user interface for a web-based hearing evaluation, including instructions, controls, indicators, and progress status, according to one embodiment.
Figure 6:
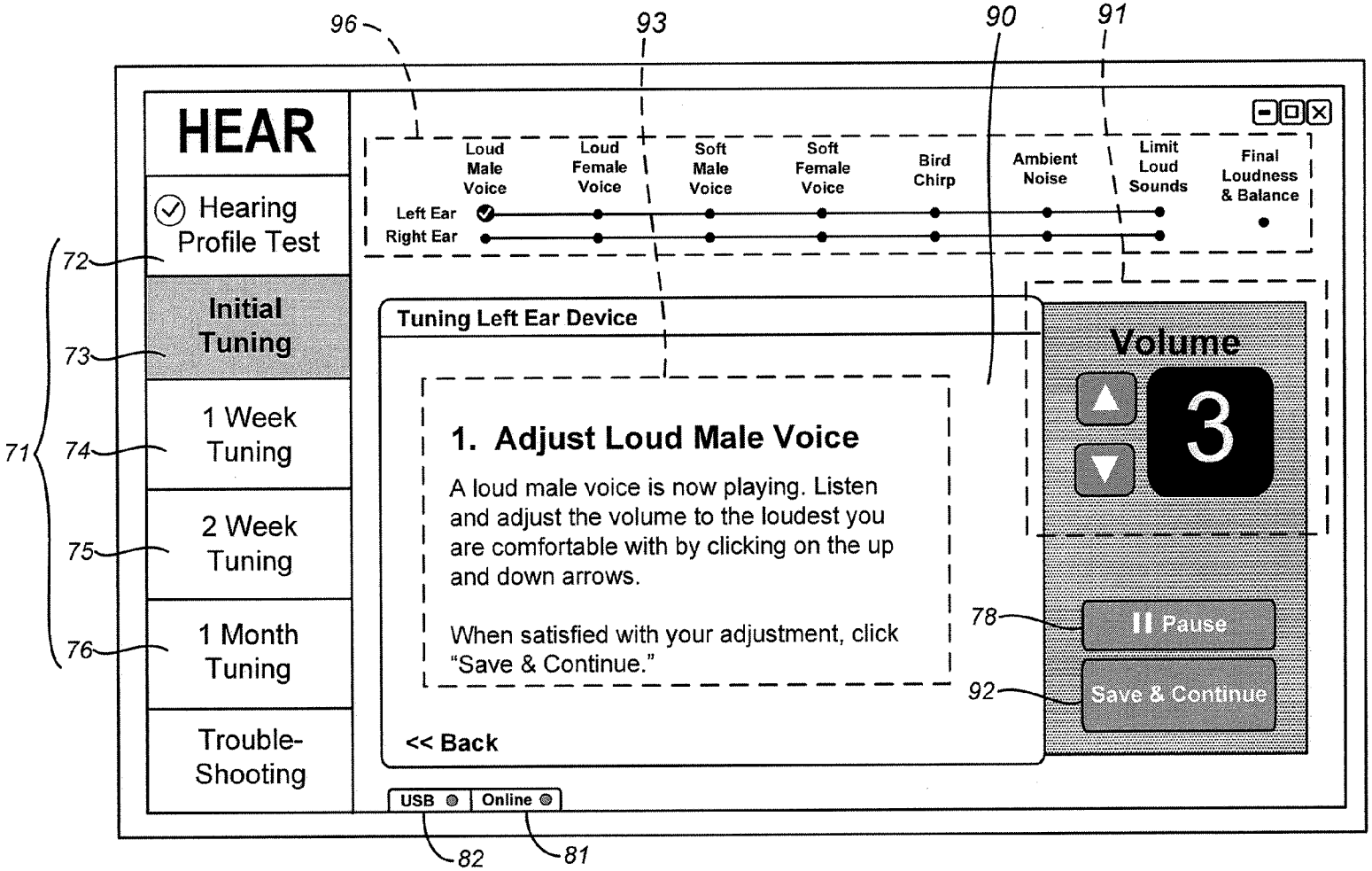
FIG. 6 is a representation of a user interface to adjust loudness and corresponding high-level gain during a presentation of loud male speech for an online hearing aid fitting application, including instructions, controls, indicators, and process status, according to one embodiment.

The online systems and methods disclosed herein may allow consumers to inexpensively and interactively test their own hearing ability, and self-fit a hearing device at home, without requiring conventional fitting instruments and complex methods limited to hearing professionals and clinical setting. FIGS. 5 and 6 show examples of a browser-based user interface (UI) for hearing aid fitting using a personal computer 10 with a generic web browser. In the example embodiments, the fitting process 71 includes a hearing profile test (hearing evaluation) process 72, initial fitting process 73, 1-week adjustment process 74, 2-week adjustment process 75, and 1-month adjustment process 76.

FIG. 5 shows one embodiment of a hearing evaluation user interface (UI) 70 for an online hearing profile test process 72 as part of an example fitting process 71. The hearing evaluation UI 70 includes user instructions 77, pause control 78, test presentation status 79, process status 83, online connection status 81, and fitting device 20 connection status 82. In this embodiment, the consumer 1 is generally instructed to listen to test signals 55 presented from the hearing device 50, or test sounds 18 presented from the earphone 17, and press the spacebar 11 when a test sound is heard.

FIG. 6 shows an embodiment of an initial fitting UI 90 for an initial fitting process 73, including volume control 91 to adjust a particular gain fitting parameter for the hearing device 50. Similarly, initial fitting UI 90 includes user instructions 93, pause control 78, save control 92, process status 96, online connection status 81, and fitting device 20 USB connection status 82. In this UI example, the user 1 is generally instructed to listen to a relatively loud sound segment presented by delivering test audio signal 21 to an audio input and adjust the volume control 91 until in-situ hearing aid output 55 is perceived loud but comfortable as per instruction 93. The response of the consumer 1 to test signals by hearing aid output 55 within the ear canal 2 is generally according to a subjective assessment, without resorting to specialized instruments, such as a probe tube microphone inside the ear, which generally uses REM instrumentation to obtain an objective measurements of acoustic signals outside and within the ear canal. The subjective assessment and response in the example of FIG. 6 deals with "volume" (loudness) assessment using the volume control 91. Other examples, shown in the process status UI 90 of FIG. 6, relate to other subjective aspects of audibility, such as audibility and clarity of a "Soft Female Voice," annoyance of an "Ambient Noise," and audibility of a high-frequency "Bird Chirp" Sound.

Figure 7:
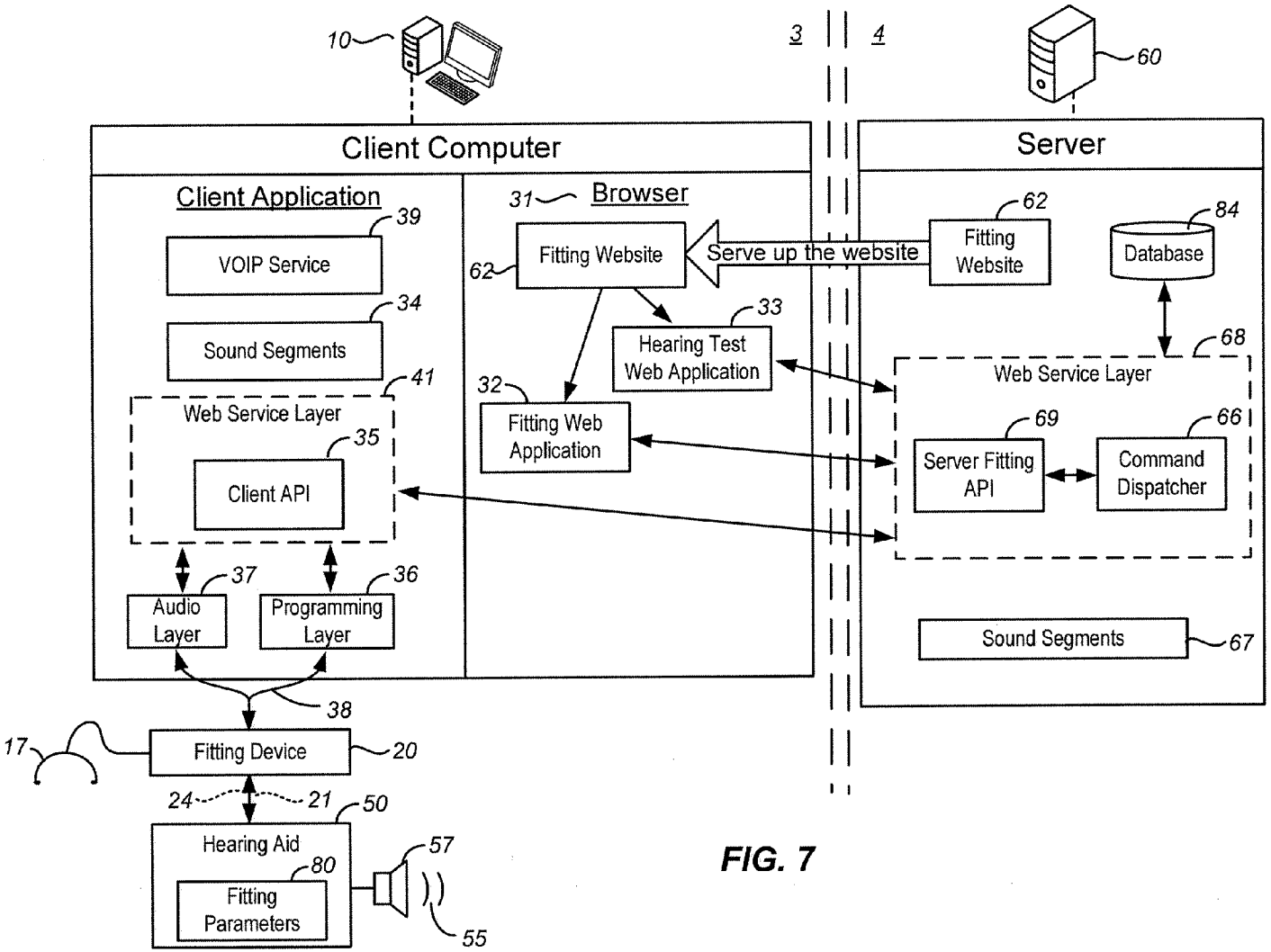
FIG. 7 is a block diagram depicting example software components and an example process flow for an example online fitting system, including web service components across the client and the remote sides, according to one embodiment.

FIG. 7 illustrates an example software infrastructure and process flow for an online fitting system. The server 60 on the remote side 4 is configured to host a Fitting Website 62 and serve Fitting Web Application 32 and Hearing Test Web Application 33 to the computer 10, for example when requested by a browser 31 positioned on the client side 3. When the initial fitting process 73 is launched by the browser 31 and corresponding initial fitting UI 90 is displayed, as shown in FIG. 6, adjustment of one or more hearing aid fitting parameters 80 may be made by the consumer 1 using the provided UI controls. For example, the consumer 1 may use volume control 91 to adjust a gain parameter associated with a "Loud Male Voice." A test audio signal 21 corresponding to "Loud Male Voice" is delivered to an audio input of the hearing device 50 for digital signal processing (for example DSP 56 in FIG. 3) by the hearing aid according to fitting parameters 80 programmed within. The consumer 1 is instructed, for example by instructions 93, to listen to hearing aid output 55 and accordingly to adjust volume control 91. The UI adjustment causes Fitting Web Application 32 on the client side 3 to call a procedure from a Server Fitting API 69 on the server 60 on the remote side 4 to trigger a corresponding set of Client API 35 calls using the Command Dispatcher 66. The Client API 35 on the client side 3 processes commands from the Command Dispatcher 66 and forwards calls to the programming layer 36 on the client side 3. In the example embodiments, the programming layer 36 produces $I^2C$ commands for the fitting device 20 via USB connection 38, which subsequently delivers programming signals 24 to the hearing device 50 to implement adjustment of fitting parameters 80 according to a UI control adjustment made by the consumer 1, or a person assisting the consumer, or a customer support personnel 6 on a remote side 4, as will be further described below. The interactive process of delivering test audio signals 21 representing test sound segments 34 may be substantially similar to the aforementioned process for delivering programming signals 24, using audio layer 37 to deliver digital audio streams to the fitting device 20 through USB connection 38. The fitting device 20 subsequently produces audio signals 21 from the audio signal generator 22 to deliver to an audio input of the hearing device 50.

The disclosed online fitting system 100 in the example embodiments allows consumers to manipulate complex hearing aid fitting parameters 80 primarily based on the subjective assessment of audibility of hearing aid output 55 produced by the in-situ hearing aid with the server hosted fitting application accessible from a personal computer with a generic browser. The interactive online process of fitting parameter adjustment is repeated for each sound segment until all session fitting parameters 80 are adjusted according to the consumer's preference, thus forming an individualized "prescription" without relying on a professional to determine or program the prescription for a consumer. Subsequent adjustments to fitting parameters 80 may be administered after the initial fitting process 73, for example to fine tune fitting parameters 80 after adaptation and gaining listening experience with the hearing device 50, or after experiencing a difficult listening scenario with a particular subscription. In some embodiments, multiple sets of fitting parameters are provided for the consumer to deal with a variety of listening condition. In some embodiments, test audio segments 34 are selected with minimal overlap in amplitude and frequency characteristics, thus minimizing overlap in fitting parameter control, and expediting a convergent fitting process for administration by a non-expert user, including self-fitting. Various data and software components of the fitting software system, such as digital audio files representing sound segments 34, calibration data for producing calibrated levels of test sounds, patient info, test results, and the like, may be stored on the personal computer 10, the handheld fitting device 20, the server 60, and/or a database server 84. For example, sound segments 67 may be stored on the remote server 60, as shown in FIG. 7.

Figure 8:
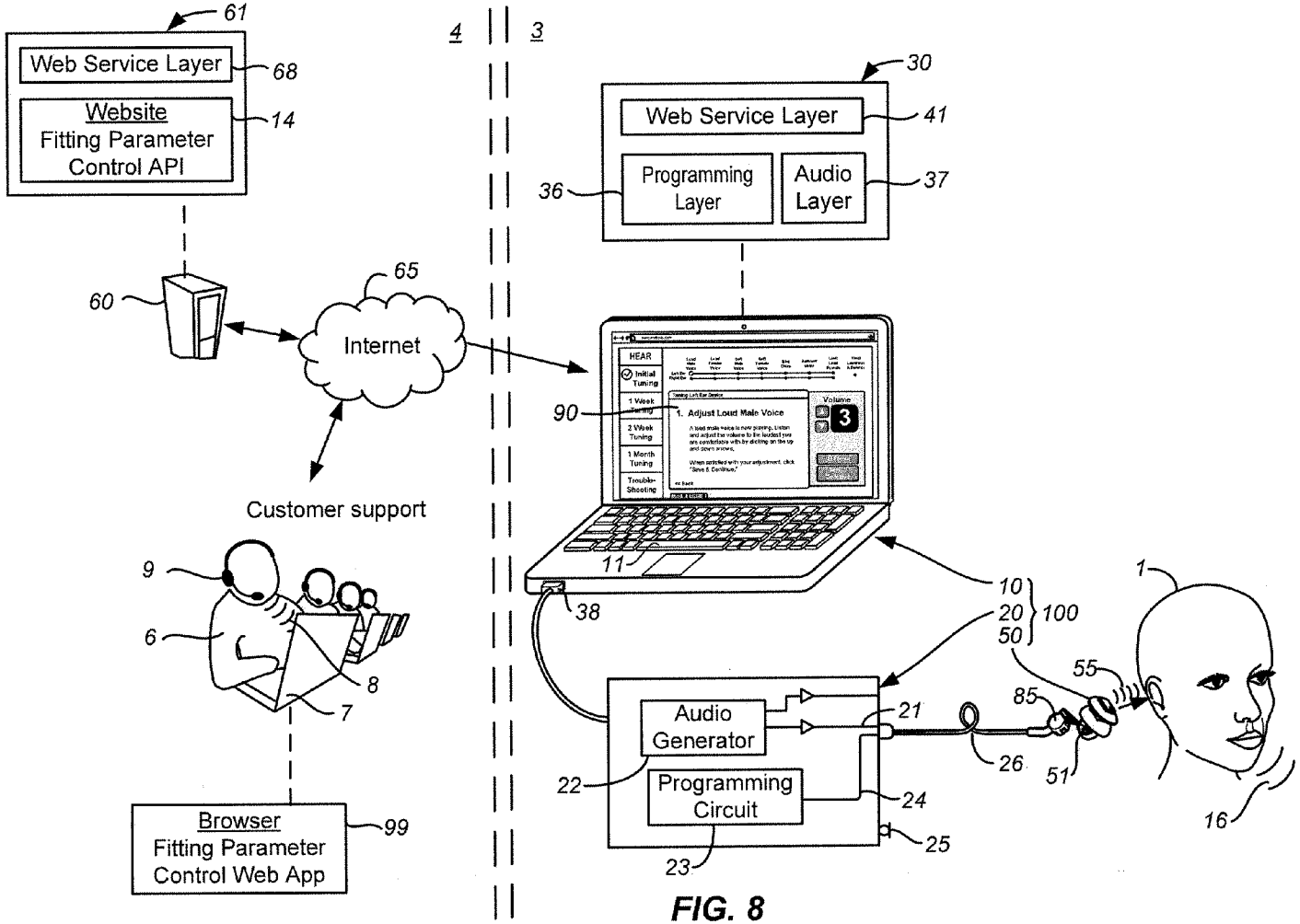
FIG. 8 is a representation of an online customer support system configured to remotely perform hearing aid programming and control and online streaming of voice instructions to the consumer positioned on the client side, according to one embodiment.

In one embodiment, shown in FIG. 8, the fitting system 100 is connected online to a remote customer support computer 7 configured as a customer support control system allowing for remote hearing aid control and adjustment by fitting parameter control API 14 hosted on a web server 60 for executing by a browser 99 on customer support computer 7. For example, the customer support personnel 6 may operate a user interface associated with fitting parameter control API 14 to send control commands online to the fitting system 100 at the client side to remotely adjust one or more fitting parameters of the hearing device 50. The customer support control system also allows audio streaming from customer support computer 7 to deliver test audio signals to the consumer's hearing device 50 as described above, or to deliver verbal (voice) communications from customer support personnel 6. For example, the customer support control system may be used to deliver voice instructions 8 from a headset 9 worn by customer support personnel 6 on the remote side 4 to the consumer 1 positioned on the client side 3 through the aforementioned method and processes of delivering audio signal 21 to non-acoustic input, and subsequently to hearing aid output 55 of the in-situ hearing device 50, for audibility by the consumer 1. The online streaming of audio signals from customer support computer 7 to the client computer 10 may be achieved, in one embodiment, using voice over internet protocol (VoIP) through a VoIP service 39 (FIG. 7) at the client side 3 in communication with a VoIP service and server (not shown) on the remote side 4. FIG. 8 also shows two-way communications method between the hearing impaired customer 1 positioned on the client side 3 and a customer support personnel 6 positioned on the remote side 4 using a fitting system microphone 25 to pick up customer voice 16 and speaker 57 of the hearing device 50 on the client side to deliver customer support voice 8 received by the headset 9 of customer support personnel 6 positioned on the remote side 4, using VoIP in one embodiment. The fitting system 100 is essentially configured to receive commands from the customer support personnel 6, where a command triggers a transmission of programming signal 24 from the fitting system 100 to the programmable hearing device 50 to adjust one or more fitting parameter 80 of the programmable hearing device 50. In the preferred embodiments, the online fitting application, fitting parameter control application, and customer support application are at least partially hosted by one or more remote servers.

Using the web-based applications and processes described above, consumer data including fitting parameters, may be readily stored and retrieved by the consumer 1, customer support personnel 6, or the manufacturer of a hearing device. Furthermore, any of the aforementioned processes may be performed from virtually any location with a computer and online access, simply by connecting the handheld fitting device 20 to an available online connected personal computer via a standard USB port. In one embodiment, a consumer may login to a personal account to access the aforementioned web-based fitting services, as well as other services related to the dispensing of a hearing device, such as ordering hearing aid parts, subscribing, payments, and the like. The hearing device 50 may be communicatively coupled to the fitting system for administering a fitting process involving hearing aid parameters 80, to receive test audio signals 21 to an input, and to receive programming signals 24. The online-based fitting system may also allow for real-time as well as recorded monitoring of an online fitting session.

The online fitting system and methods disclosed herein enable home hearing aid dispensing, including delivery of a hearing aid 50 to the consumer's home, by mail for example, and to administer home hearing evaluation, prescription, and fitting using the fitting device 20 and the online fitting process. Additionally, the online fitting system and interactive methods disclosed herein may enable self-fitting for a consumer 1 with minimal computer skills, or by a non-expert person assisting the consumer 1. This allows for a more affordable and accessible hearing aid solution for the rapidly growing aging population with increased access to the Internet 65, and utilization thereof.

Although embodiments of the invention are described herein, variations and modifications of these embodiments may be made, without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. An online fitting system for fitting a hearing device for a consumer, the system comprising:

a programmable hearing device configured to deliver a sequence of output signals in-situ in response to non-acoustic inputs, each output signal of the sequence corresponding to a sound segment, wherein the output signals are delivered according to fitting parameters programmed into the programmable hearing device;

a programming interface configured to deliver programming signals to the programmable hearing device in-situ; and a computing device configured to execute a fitting application, the computing device communicatively coupled online to a remote server, wherein the computing device is configured to receive a consumer input indicative of a subjective assessment of the consumer of each of the sound segments, wherein the consumer input is configured to adjust one or more fitting parameters associated with the output signal corresponding to the sound segment being assessed, wherein the fitting application is configured to generate the programming signals to make adjustments to the fitting parameters in accordance with the consumer input and is further configured to deliver the programming signals to the programmable hearing device in-situ via the programming interface, wherein the adjustments comprise a first adjustment made to one or more fitting parameters associated with an output signal corresponding to a relatively loud sound segment and a second adjustment made to one or more fitting parameters associated with an output signal corresponding to a relatively soft sound segment.

2. The online fitting system of claim 1, wherein the system is configured for self-administration by the consumer.

3. The online fitting system of claim 1, wherein the system is configured for administration by a non-expert operator.

4. The online fitting system of claim 1, wherein the fitting application is executed as a web application.

5. The online fitting system of claim 1, wherein the fitting application is executed as a standalone application.

6. The online fitting system of claim 1, further comprising an earphone configured to deliver a sound input to administer a hearing evaluation.

7. The online fitting system of claim 1, further comprising a microphone configured to sense sound in the vicinity of the consumer.

8. The online fitting system of claim 1, the programming interface is part of a handheld device configured to deliver the programming signals.

9. The online fitting system of claim 8, wherein the handheld device is communicatively coupled to a personal computer by a USB connection.

10. The online fitting system of claim 1, wherein the programming signals are delivered to the programmable hearing device by an electrical connection.

11. The online fitting system of claim 1, wherein the programming signals are delivered to the programmable hearing device by a wireless connection.

12. The online fitting system of claim 1, wherein the consumer input includes consumer input indicative of the relatively loud sound segment being perceived as loud but comfortable.

13. An online hearing device fitting system, comprising:

a programmable hearing device configured to be worn in an ear of a consumer and produce output signals representative of a relatively loud sound segment and a relatively soft sound segment;

a handheld device comprising an audio signal generator configured to transmit a hearing test signal to a speaker positioned in the ear of the consumer, wherein the hearing test signal is configured for administering a hearing evaluation, and wherein the speaker is configured to deliver an acoustic test signal in response to the hearing test signal to administer the hearing evaluation;

a programming interface configured to deliver programming signals to the programmable hearing device in-situ, wherein the programming signals are delivered to the programmable hearing device according to a consumer input indicative of a subjective assessment of the consumer to the sound segments produced by the programmable hearing device, wherein the consumer input is configured to adjust one or more fitting parameters of the programmable hearing device; and a personal computer configured to execute a fitting application communicatively coupled to the handheld device and a remote server, wherein the personal computer is configured to receive the consumer input, wherein the fitting application is configured to generate programming signals to make adjustments to the fitting parameters in accordance with the consumer input, wherein the adjustments comprise a first adjustment made to one or more fitting parameters associated with an output signal corresponding to the relatively loud sound segment and a second adjustment made to one or more fitting parameters associated with an output signal corresponding to the relatively soft sound segment.

14. The online hearing device fitting system of claim 13, wherein the speaker is incorporated within an earphone.

15. The online hearing device fitting system of claim 13, wherein the speaker is incorporated within the programmable hearing device.

16. The online hearing device fitting system of claim 13, wherein the hearing test signal is representative of a sequence of acoustic test signals in each of three or more test frequency bands within an audiometric frequency range, wherein a step level for consecutive acoustic test signals at each test frequency band is at least 10 dB.

17. The online hearing device fitting system of claim 13, wherein the hearing test signal is representative of a sequence of acoustic test signals at suprathreshold levels of at least 20 dB HL.

18. A system for hearing device fitting, the system comprising:

a programmable hearing device configured to be worn by a customer, wherein the programmable hearing device is configured to produce a sequence of output signals in-situ in response to non-acoustic inputs, each output signal of the sequence corresponding to a sound segment, wherein the output signals are delivered according to fitting parameters programmed into the programmable hearing device; and a personal computer communicatively coupled to the programmable hearing device, wherein the computing device is configured to receive a consumer input indicative of a subjective assessment of the consumer of each of the sound segments, wherein the consumer input is configured to adjust one or more fitting parameters associated with the output signal corresponding to the sound segment being assessed, wherein the personal computer is connected online to a customer support computer, wherein the personal computer is configured to receive a support audio signal streamed from the customer support computer, and wherein the personal computer is further configured to deliver the support audio signal to the programmable hearing device, wherein a fitting application of the personal computer is configured to generate programming signals to make adjustments to the fitting parameters in accordance with the consumer input and is further configured to deliver the programming signals to the programmable hearing device in-situ, wherein the adjustments comprise a first adjustment made to one or more fitting parameters associated with an output signal corresponding to a relatively loud sound segment and a second adjustment made to one or more fitting parameters associated with an output signal corresponding to a relatively soft sound segment.

19. The online customer support system of claim 18, wherein the support audio signal comprises a voice of a customer support personnel.

20. The online customer support system of claim 18, wherein the support audio signal is a test signal.

21. The online customer support system of claim 18, wherein the support audio signal is transmitted to the personal computer by a voice over internet protocol (VOIP).

22. An online hearing device fitting system for a customer wearing a programmable hearing device, the system comprising:

a programmable hearing device configured to be worn by a customer in an ear, the programming hearing device configured to produce a sequence of output signals in-situ in response to non-acoustic inputs, each output signal of the sequence corresponding to a sound segment, wherein the output signals are delivered according to fitting parameters programmed into the programmable hearing device; and a personal computer communicatively coupled to the programmable hearing device, wherein the personal computer is connected online to a customer support computer operated by a customer support personnel at a customer support site remotely located from the customer, wherein the personal computer is configured to receive a consumer input indicative of a subjective assessment of the consumer of each of the sound segments, wherein the consumer input is configured to adjust one or more fitting parameters associated with the output signal corresponding to the sound segment being assessed, and wherein the personal computer comprises a fitting application configured to generate programming signals to make adjustments to the fitting parameters in accordance with the consumer input and is further configured to deliver the programming signals to the programmable hearing device in-situ via the programming interface, wherein the adjustments comprise a first adjustment made to one or more fitting parameters associated with an output signal corresponding to a relatively loud sound segment and a second adjustment made to one or more fitting parameters associated with an output signal corresponding to a relatively soft sound segment, wherein the personal computer is configured to receive from the customer support computer commands to remotely adjust one or more fitting parameters of the programmable hearing device.

23. A method of online hearing device fitting for a client, the method comprising:

delivering a sequence of output signals from a programmable hearing device in-situ in response to non-acoustic inputs, each output signal of the sequence corresponding to a sound segment, wherein the output signals are delivered according to fitting parameters programmed within the programmable hearing device, wherein the acoustic output is representative of fitting sound segments comprising a sound input;

adjusting the fitting parameters of the programmable hearing device according to a consumer input received by a computing device, wherein the consumer input is indicative of a subjective assessment of the consumer of each of the sound segments, and wherein the consumer input is configured to adjust one or more fitting parameters associated with the output signal corresponding to the sound segment being assessed; and generating a programming signal to make adjustments to the fitting parameters in accordance with the consumer input, including making a first adjustment to one or more fitting parameters associated with an output signal corresponding to a relatively loud sound segment and making a second adjustment to one or more fitting parameters associated with an output signal corresponding to a relatively soft sound segment.

24. The method of claim 23, further comprising administering a hearing evaluation by delivering an acoustic test stimulus to an ear of the client.

25. The method of claim 24, wherein any of the steps are self-administered by the client.

26. The method of claim 24, wherein any of the steps are administered by a non-expert person assisting the client.

27. The method of claim 23, wherein the programming signal is generated by a personal computer configured to execute a fitting application.

28. The method of claim 27, wherein the fitting application is executed from a web browser.

29. A method of online fitting of a programmable hearing device of a client, the method comprising:

executing a hearing test application by a fitting system located at the client side, wherein the fitting system is configured to produce an output representative of a sound input in-situ to an ear of a client for a hearing evaluation;

executing a fitting application by the fitting system, wherein the fitting system is configured to adjust fitting parameters of the programmable hearing device in-situ;

producing a sequence of output signals by the programmable hearing device in-situ in response to non-acoustic inputs, each output signal of the sequence corresponding to a sound segment, wherein the output signals are delivered according to the fitting parameters programmed within the programmable hearing device; and adjusting the fitting parameters according to a consumer input received by computing device, wherein the consumer input is indicative of a subjective assessment of the consumer of each of the sound segments, and wherein the consumer input is configured to adjust one or more fitting parameters associated with the output signal corresponding to the sound segment being assessed;

generating programming signals from the fitting system to make adjustments to the fitting parameters in accordance with the consumer input, wherein a first adjustment is made to one or more fitting parameters associated with an output signal corresponding to a relatively loud sound segment and a second adjustment is made to one or more fitting parameters associated with an output signal corresponding to a relatively soft sound segment.

30. The method of claim 29, wherein any of said steps are self-administered by the client.

31. The method of claim 29, wherein any of said steps are administered by a non-expert operator assisting the client.

32. The method of claim 29, wherein the fitting system comprises a personal computer configured to execute any of the hearing test application and the fitting application.

33. The method of claim 29, wherein the fitting system comprises a handheld device configured to deliver the programming signals.

34. The method of claim 29, wherein any of the hearing test application and the fitting application are configured to execute from a web browser.

35. The method of claim 29, wherein the sound input is configured to be delivered to the ear of the client by an earphone.

36. The method of claim 29, further comprising sensing sound in the vicinity of the client by a microphone incorporated within the fitting system.

37. The method of claim 36, wherein the sensing of sound in the vicinity of the client is incorporated in the process of administering the hearing evaluation.

38. A method of online customer support for a hearing aid client, the method comprising:

connecting a fitting system online to a customer support computer system at a remote customer support site;

communicatively coupling the fitting system to a programmable hearing device in-situ, wherein the programmable hearing device is configured to produce a sequence of output signals in-situ, each output signal of the sequence corresponding to a sound segment, wherein the output signals are delivered according to fitting parameters programmed within the programmable hearing device;

receiving a support audio signal by the fitting system from the customer support computer system;

generating an audio signal by the fitting system, wherein the audio signal is representative of the support audio signal;

delivering the audio signal to the programmable hearing device in-situ;

delivering an audible output from the programmable hearing device in-situ, wherein the audible output is representative of the support audio signal; and receiving a consumer input by the fitting system, wherein the consumer input is indicative of a subjective assessment of the consumer of each of the sound segments, and wherein the consumer input is configured to adjust one or more fitting parameters associated with the output signal corresponding to the sound segment being assessed, generating a programming signal from the fitting system to make adjustments to the fitting parameters in accordance with the consumer input, wherein a first adjustment is made to one or more fitting parameters associated with an output signal corresponding to a relatively loud sound segment and a second adjustment is made to one or more fitting parameters associated with an output signal corresponding to a relatively soft sound segment.

39. The method of claim 38, wherein the support audio signal represents voice communications from a customer support personnel at the customer support site.

40. The method of claim 38, wherein the support audio signal represents a test signal.

41. The method of claim 38, wherein the fitting system comprises a personal computer.

42. The method of claim 38, wherein the fitting system comprises a handheld device configured to deliver the programming signal to the programmable hearing device.

43. The method of claim 38, wherein the fitting system is configured to receive a command from the customer support computer system, and wherein the command triggers a transmission of the programming signal from the fitting system to the programmable hearing device.

44. A method of online customer support for a hearing device client, the method comprising:

connecting online a fitting system at the client side to a customer support computer remotely positioned, wherein the fitting system is communicatively coupled to a programmable hearing device, wherein the programmable hearing device is configured to produce a sequence of output signals in response to non-acoustic inputs, each output signal of the sequence corresponding to a sound segment, wherein the output signals are produced according to fitting parameters programmed into the programmable hearing device, wherein the fitting system is configured to generate programming signals configured to make adjustments to fitting parameters of the programmable hearing device in accordance with consumer input received by the fitting system, wherein the consumer input is indicative of a subjective assessment of the consumer of each of the sound segments, wherein the consumer input is configured to adjust one or more fitting parameters associated with the output signal corresponding to the sound segment being assessed, and wherein the programming signals comprise instructions configured to make a first adjustment to one or more fitting parameters associated with an output signal corresponding to a relatively loud sound segment and a second adjustment to one or more fitting parameters associated with an output signal corresponding to a relatively soft sound segment; and adjusting one or more hearing aid parameters by the fitting system according to commands received from a hearing device control application executed by the customer support computer.

45. The method of claim 44, wherein the fitting system comprises a personal computer.

46. The method of claim 44, wherein the fitting system comprises a handheld device configured to deliver the programming signals.

* * * * *